United States Patent [19]

MacDonald et al.

[11] 4,083,160

[45] Apr. 11, 1978

[54] RELIEF PANEL AND METHOD OF MAKING SAME

[76] Inventors: Edward J. MacDonald, 180 Border St., Scituate, Mass. 02066; Kenneth A. MacDonald, 251 York St., Canton, Mass. 02021

[21] Appl. No.: 769,953

[22] Filed: Feb. 18, 1977

Related U.S. Application Data

[63] Continuation-in-part of Ser. No. 565,143, Apr. 4, 1975, Pat. No. 4,008,551.

[51] Int. Cl.[2] ..... E04C 1/40; E06B 3/70

[52] U.S. Cl. ..... 52/316; 52/456; 52/622; 156/63; 156/257

[58] Field of Search ..... 52/312, 316, 456, 622; 156/257, 258, 63; 428/67

[56] References Cited

U.S. PATENT DOCUMENTS

| | | | |
|---|---|---|---|
| 1,988,236 | 1/1935 | Chatfield | 52/312 |
| 2,253,667 | 8/1941 | Warner | 156/268 X |
| 2,842,420 | 7/1958 | Hansen et al. | 312/204 X |
| 3,022,207 | 2/1962 | Lang | 156/257 |
| 3,731,444 | 5/1973 | Tobin | 52/316 |
| 4,008,551 | 2/1977 | MacDonald et al. | 52/622 |

*Primary Examiner*—Alfred C. Perham

*Attorney, Agent, or Firm*—Morse, Altman, Oates & Bello

[57] ABSTRACT

Structural and decorative unitary boards which may be laminated with a veneer are given a relief appearance by forming a rabbeted groove in the front face thereof, preferably rectangular in outline, and mounting therein from the front, tapered laminated strips having a thickness along one edge slightly less than the depth of the groove and the opposite narrow edge being substantially flush with the base of the groove. The entire panel thus presents a relief configuration in which substantially all of the exposed surfaces may be covered by the veneer. The panels may be used for doors used in kitchen cabinets, bathroom vanities and the like.

10 Claims, 8 Drawing Figures

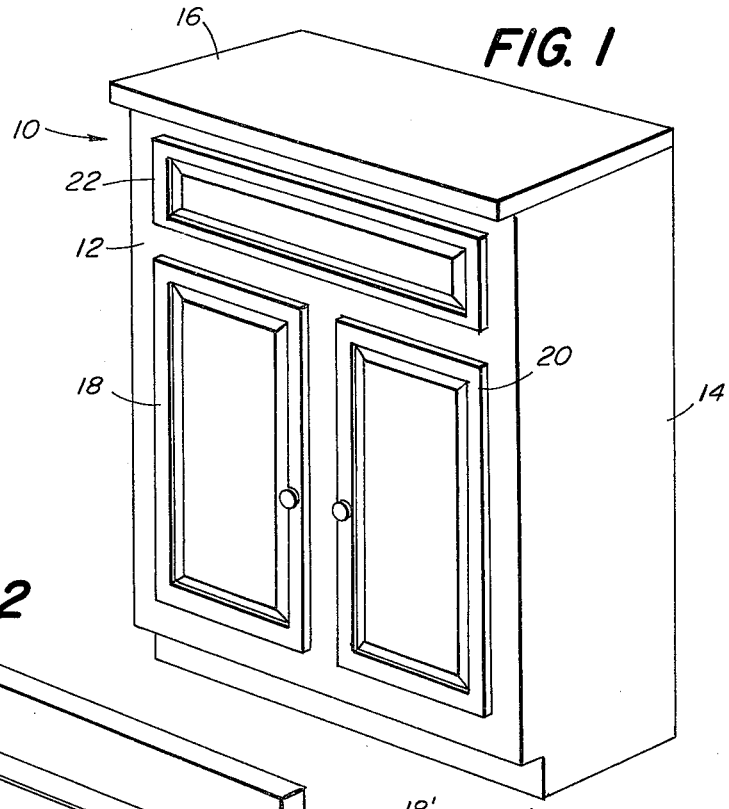
FIG. 1
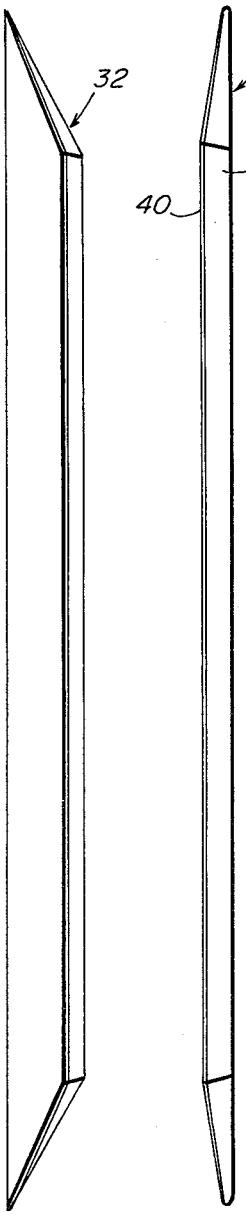
FIG. 4 FIG. 5
FIG. 2
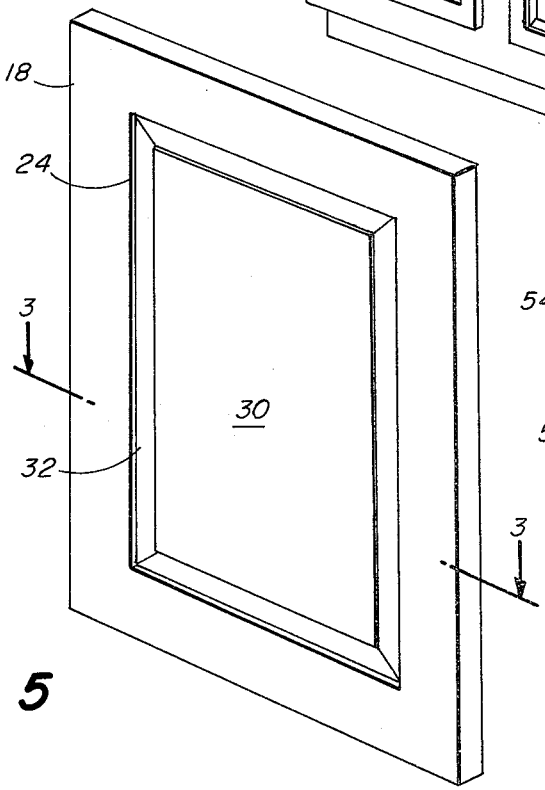
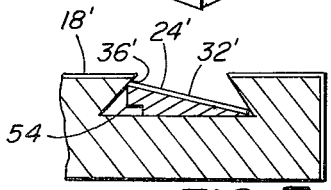
FIG. 7
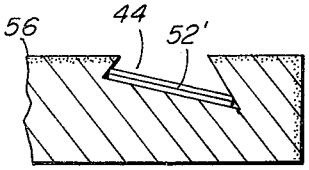
FIG. 8
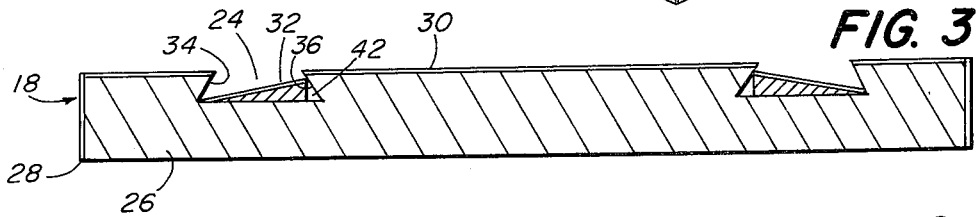
FIG. 3
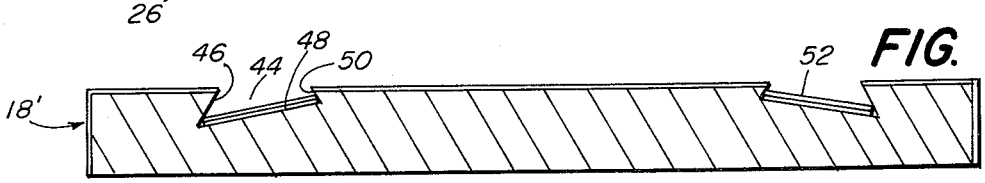
FIG. 6

RELIEF PANEL AND METHOD OF MAKING SAME

CROSS-REFERENCE TO RELATED APPLICATION

This is a continuation-in-part of our U.S. Application Ser. No. 565,143, filed Apr. 4, 1975, now U.S. Pat. No. 4,008,551 and entitled "Relief Panel and Method of Making Same."

BACKGROUND OF THE INVENTION

1. Field of the Invention

This invention relates generally to sheetboard products such as doors and panels and especially those manufactured from a veneered core of chipboard, particle board, or the like. More particularly the invention is directed towards a new and improved method of providing a relief surface to a panel having a one-piece core which may be laminated with a hard plastic or other veneer surface and the product made thereby irrespective of the veneer thickness.

2. Description of the Prior Art

Many products utilize veneers such as those sold under the trademark "Formica" and which includes a stratum of urea-and-phenol-formaldehyde resins, bonded to a sheet of plywood, chipboard or the like. Such panels are strong and the hard plastic veneer is extremely durable, presenting a smooth, hard surface. Such laminated boards are used for wall panels in some instances, but more commonly are used in kitchen cabinets, vanities and the like where resistance to water spotting, ease of cleaning and other characteristics are desirable.

While cabinets fabricated, either in whole or in part, by such laminated boards are very durable and functional they are limited with respect to the design configurations which may be produced using such boards. Generally, such boards are available only in flat, smooth stock which cannot be milled into attractive cabinet work since the milling would remove parts of the hard plastic veneer and the ultimate finishing would be extremely expensive. As a result, cabinets currently available which are fabricated from such laminated board have utilized doors, panels, etc., which are either completely flat and smooth or have a very light, shallow scoring formed therein in an attempt to provide some relief appearance to the product.

Accordingly, it is an object of the present invention to provide a novel method for producing a genuine relief surface to such laminated boards while maintaining an outer exposed surface of the panel that is substantially fully covered by the veneer. A further object of the invention is to provide relief cabinet doors, panels and the like fabricated from veneer boards such as chipboard, particle board, and the like, covered by veneers such as vinyls, hard plastics, wood, prints and those commonly known as UV surfaces and the like.

SUMMARY OF THE INVENTION

This invention features the method of producing a relief surface in an initially smooth, flat, unitary panel made from a core of wood, chipboards, or the like, covered by a veneer or other surface finish comprising the steps of forming a rabbeted groove in the front face of the panel through the front surface only and into the core and then mounting a strip in the groove from the front of the panel, the strip being transversely tapered and of a width substantially corresponding to the width of the groove.

This invention also features a relief panel of a core of wood, chipboard, or the like, covered by a veneer or other surface finish, comprising a unitary, flat panel formed with an undercut groove in the front face of the panel through the veneer or other surface and into the core of the panel and a transversely tapered insert mounted in the groove from the front face of the panel, the insert being faced with a veneer or other surface to provide a substantially continuous surface of veneer or other surface to the outer face of the panel.

BRIEF DESCRIPTION OF THE DRAWINGS

FIG. 1 is a view in perspective of a cabinet fabricated with doors and panel sections made according to the invention, FIG. 2 is a view in perspective of a door made according to the invention, FIG. 3 is a cross-sectional view taken along the line 3—3 of FIG. 2, FIG. 4 is a view in perspective of an insert made according to the invention, FIG. 5 is a view in side elevation of the FIG. 4 insert, FIG. 6 is a cross-sectional view similar to FIG. 3 but showing a modification of the invention, FIG. 7 is a detail sectional view showing another modification of the invention, and, FIG. 8 is a view similar to FIG. 7 showing a further modification of the invention.

DETAILED DESCRIPTION OF THE PREFERRED EMBODIMENTS

Referring now to the drawings and to FIG. 1 in particular, the reference character 10 generally indicates a cabinet of the sort used in kitchens, bathrooms, and the like, and comprised of the usual front frame 12, sidewalls 14 and countertop 16. Typically, such cabinets include a pair of doors 18 and 20 and a panel 22 which may be either the outer end of a drawer or, if the cabinet 10 is used as a vanity with a sink (not shown) mounted in the counter, the panel 22 would be a fixed decorative trim piece.

Cabinets of the type illustrated in FIG. 1, in many instances, are fabricated largely of a laminated board material in which the core is a wood fibre material such as plywood or chipboard while the outer surface is a hard plastic veneer such as that sold under the trademark "Formica" which is made from urea-and-phenol-formaldehyde resins cured to a smooth, hard, durable finish. Such laminated materials are structurally strong and the plastic veneer finish provides a smooth, hard, waterproof working surface which is extremely durable and easy to clean. However, such laminated boards heretofore have been available only in flat stock and, as a result, the appearance of the finished cabinets have lacked the mill-work relief surface which may be done easily on conventional wood panels. While decorative scrolling may be done to the surface of the plastic veneer, care must be taken not to penetrate the veneer. If the veneer is penetrated it then becomes necessary to either upgrade the type of core used or carry out expensive finishing operations.

In accordance with the present invention, as embodied in the door 18 of FIG. 2, a true relief configuration is imparted to the outer face of the one-piece door by first milling from the front of the panel a rabbeted groove 24 into the outer face of the panel. As best shown in FIG. 3, the panel is comprised of a unitary core 26 typically of chipboard, plywood or similar material, perhaps ½ inch thick, having good structural strength, while the outer face and edges of the panel are covered with a veneer 28 of hard plastic material such as that sold under the trademark "Formica" and which is fully bonded to the core 26. The groove 24, in the illustrated embodiment, is in a rectangular pattern inboard perhaps 2 inches from the edge of the door leaving a rectangular center section 30 defined by the groove.

In the preferred embodiment, the groove is on the order of 5/16 inch in depth having a width of approximately 1¼ inches at its base and approximately ⅞ inch at the groove opening. As best shown in FIG. 3, both sides of the grooves are angled in the manner shown for mounting an insert 32. Furthermore, the rabbeted groove provides a shadow effect which substantially obscures from view the exposed portion of the core along inclined walls 34 and 36 of the groove in which the core 26 is not covered by the plastic veneer. These inclined walls may be stained or painted to match the color of the veneer 28 or may be left unfinished since they are well hidden by the undercutting. More importantly, the undercut groove creates an illusion of a raised center panel 30. Also, the rabbeted groove serves to retain the insert strip 32 mounted in the groove.

The insert 32, as shown in FIGS. 3, 4 and 5, is comprised of an elongated strip for each section of the groove, with each strip comprised of a core 38 on the outer face of which is laminated a veneer 40 of a material similar to that on the laminated door 18. The core 38 may be of the same chipboard material, as in the core 26, or other material such as wood, or a relatively stiff plastic such as PVC, or the like, may be utilized. The hard plastic veneer 40 may be of the same color and design as that used on the door or it may be of a contrasting color, a different pattern or other variation as desired. In any event, the insert 32 is wedge-shaped or tapered in transverse cross-section, as shown in FIG. 3, with the ends mitered at 45° angles to match similarly mitered ends of adjacent inserts to form neatly mitered corners as best shown in FIG. 2. The thin edge of the insert seats along the outer corner of the groove 24 while the thicker edge, which is slightly less than the depth of the groove 24, is disposed against the inner portion of the groove and against the wall 36. In practice, the thicker portion is ¼ inch thick, being approximately 1/16 inch less than the depth of the groove so that the inboard front edge of the insert will butt against the groove wall 36 below the outer surface and against the core 26, typically located inwardly by about 1/16 inch from the outer groove edge forming a slight overhang. The width of the insert is not critical and can be 1/16 inch narrower than specified and still produce an acceptable appearance.

The base of the insert, which has a cross-section of a right triangle, as best shown in FIG. 3, is perpendicular to the flat bottom wall of the groove 24 to define a triangular void 42 which allows the insert to be manipulated in and out of the groove. In practice, the insert is dimensioned to fit neatly within the groove so that the insert may be held in place by friction fit and leaving exposed only the inclined outer side wall 34 of the groove 24. Insofar as the wall is inclined outwardly towards the edge it will not be readily apparent to the casual viewer. However, in some instances it may be desirable to apply a coating of paint or stain over the inclined outer wall of the groove to match the panel surface or to match the insert surface, if they differ.

While the insert, if carefully fabricated, may snap into position and be held by friction, it may be desirable to cement the insert in place. In this case, because of the undercut, much greater tolerances may be used than would be possible if the groove had perpendicular side walls. In practice, good mitered joints can be produced with inserts cut to length within a tolerance of 1/16 inch for each piece and a total of ¼ inch tolerance for the four inserts. This feature virtually eliminates the need for slow and expensive hand fitting usually required for work of this nature. Where a permanent connection is to be made, or if a removable insert mounting is desired, connectors such as pins may be added to the groove 24 or to the insert. Alternatively, a light, pressure-sensitive adhesive may be employed which will release if the strip is pried out of the groove.

The appearance of the finished panel with the insert mounted in the groove is one of a relief surface much like a conventional millwork panelled all-wood door with the advantage that exposed surfaces are substantially fully covered by the desirable veneer.

Referring now to FIG. 6 of the drawings, there is illustrated a modification of the invention and in this embodiment, instead of a rabbeted groove, an angular groove 44 is formed in a panel 18' definining an inclined outer wall 46 and an inclined bottom wall 48 with the bottom wall 48 originating at a narrow inclined inner wall 50 near the surface of the panel so that a strip 52 of plastic veneer, such as Formica, when applied over the wall 48, will be deeply recessed along its outer edge and slightly recessed along its inner edge. The strip 52 substantially fully covers the inclined wall 48 terminating at the base of the wall 46 to produce the same relief appearance as in the principal embodiment.

Referring now to FIG. 7 of the drawings, there is illustrated a modification of the invention and in this embodiment an insert strip 32' is mounted within a groove 24' formed in a panel 18', as in the principal embodiment. However, the insert strip 32' of this embodiment, while generally triangular in cross-section, is formed with a notch 54 in the lower inboard corner thereof. The notch 54 facilitates insertion of the strip into the groove by increasing the clearance between the inboard edge of the strip and the outer edge of the groove wall 36'. It also allows the use of an insert that is wider than the one used in the FIG. 3 embodiment. In practice, the strip is inserted by first placing the thinner edge of the strip in position from the front with the thicker portion of the strip outside of the groove. The strip is then pivoted about its thin edge until it is flat against the bottom of the groove. In this pivoting action the notch provides clearance and greater tolerance to prevent binding or force fitting which might otherwise occur.

Referring now to FIG. 8 of the drawings, there is illustrated a further modification of the invention and, in this embodiment, an inclined groove 44', similar to the inclined groove 44 of FIG. 6, is formed in a panel with a thin strip 52' covering the bottom of the groove. In this embodiment, in place of a laminated outer surface the face of the panel is provided with a coating 56 of stain, paint or the like. The strip 52' may correspond with the strip 52 of the FIG. 6 embodiment or may be stained or painted to match the coating 56. Other surface finishes may be applied to the core in this or in the other embodiments. Such finishes include vinyl clads, UV's, prints and others.

The foregoing method of producing relief panels is far simpler and quicker than conventional assembly techniques and produces a much stronger door panel, etc. It is common practice to produce a panelled door that has been assembled from a number of milled parts into the desired structure which is then nailed, cemented or the like. Such doors, while decorative, normally do not have significant structural strength because the parts are joined in edge-to-edge relation and are subject to warping and shrinkage. Using the foregoing technique, a single, rigid panel is given a relief appearance by merely working on one face of the panel, all of the milling and assembling being done from the front of the panel. The panel itself retains its original strength since it remains of one piece across its entire width and length. The technique is particularly suited for providing a relief appearance to a flat, finished panel and provides the relief appearance without significantly affecting the attributes of the surface finish, whether it be a laminate, veneer or other finish.

In practice, the insert strips are made slightly shorter in overall length insofar as cutting tolerances are not critical to producing a finished appearing panel. For example, the undercutting technique will allow for a tolerance of about $\pm 1/32$ inch in length of each strip without adversely affecting the fit of the strips. Such tolerances permit the strips to be gang cut, thereby providing production efficiency. Also, the thickness of the strips may be varied somewhat as may be the depth of the groove. In either event, sufficient tolerances are allowed so that the inner panel edge overhangs to some extent the outer edge of the insert strip. Sufficient clearance should be allowed so that the strip bears against the core material rather than the laminate or other surface finish. Thus, the technique is independent of the surface employed and can be embodied on a plain wood panel, for example. The overhanging portion of the inner panel edge should be mostly of core material to provide the structural strength to support the outer finished surface, thereby substantially eliminating any risk of chipping or irregularity in the edge of the groove during the milling or assembling operations, or in subsequent use. If the veneer only was overhanging, without any core support, its brittle characteristics would subject it to chipping and it would be difficult to cut to a smooth, finished edge. If a vinyl finish were used it would be impossible to make it overhang unsupported since it has substantially no structural strength.

The relief configuration may be applied to doors, facia pieces, drawer fronts, full wall panels, or the like, wherever a relief appearance is desired. The resultant panel makes the veneered cabinet look more like that of a conventional laid up wood panel made of assembled solid wood pieces, but with the added advantage of having a one-piece core construction for maximum strength. The technique allows for the use of a single, flat, pre-finished sheet stock to greatly simplify the production of doors, panels, etc. The utility and appearance of finished flat stock is greatly expanded since the method can be applied to a wide variety of sheet materials including vinyl clad panels, MCP panels, laminated Formica panels, birch veneered panels, etc.

Having thus described the invention, what we claim and desire to obtain by Letters Patent of the United States is:

1. The method of producing a relief surface in the front face of an integrated flat panel having a relatively thick one-piece core and a relatively thin finish on the outer surface thereof, comprising the steps of (a) cutting away an elongated groove of substantially constant width and depth inwardly from the edges of said panel in a predetermined pattern open only from said front face and completely through said finish from said front face and partially into said core, said groove being undercut along both sides thereof to form with the bottom wall of said groove a pair of acute angular corners extending parallel to the length of said groove, and, (b) applying from the front of said panel an elongated strip of substantially right triangular transverse cross-section over the bottom wall of said groove, said strip being of a thickness less than the depth of said groove with the innermost long edges of said strip being disposed in proximity to the groove corners and the third long edge thereof being disposed against said core on one side of said groove and below the outer edge of the groove.

2. The method of claim 1 wherein said strip is formed with a notch extending lengthwise along the right angular corner thereof and locating said strip in said groove with said notch adjacent the bottom wall thereof.

3. The method of producing a relief surface in the front face of an integrated flat panel having a relatively thick one-piece core and a relatively thin finish on the outer surface thereof, comprising the steps of (a) cutting away an elongated and transversely inclined groove of substantially constant width inwardly from the edges of said panel in a predetermined pattern open only from said front face and completely through said finish from said front face and partially into said core, said groove being undercut along both sides thereof to form with the inclined bottom wall of said groove a pair of acute angular corners extending parallel to the length of said groove, and, (b) applying from the front of said panel an elongated strip of substantially constant thickness over the bottom wall of said groove with the long edges of said strip being disposed in proximity to the groove corners.

4. A relief panel, comprising (a) a relatively thick one-piece core, (b) a relatively thin finish on the outer surface of said core, (c) said panel being formed inwardly from the edges thereof with an elongated undercut groove of substantially constant width and depth in a predetermined pattern completely through said finish from the front face only of said panel and partially into said core, (d) an elongated strip of triangular transverse cross-section and of a thickness less than the depth of said groove mounted over and along the bottom wall of said groove, the inboard outer edge of said strip being in butting contact with said core and in slightly recessed relation to the outer surface of said panel and the outboard edge of said strip being disposed in the outboard corner of said groove in deeply recessed relation to the outer surface of said panel.

5. A relief panel, according to claim 4, wherein said groove is rabbeted and said strip is right-triangular in transverse cross-section.

6. A relief panel, according to claim 4, wherein said strip is formed with a notch along the inside inboard corner thereof.

7. A relief panel, according to claim 4, wherein said pattern is rectangular and a strip is mounted in each portion thereof, the ends of said strips being mitered and in contact relation.

8. A relief panel, according to claim 7, wherein each of said strips includes a core of transverse right-triangular cross-section and a hard plastic veneer on the outer face thereof.

9. A relief panel, comprising (a) a relatively thick one-piece core, (b) a relatively thin finish on the outer surface of said core, (c) said panel being formed inwardly from the edges thereof with an elongated undercut and transversely inclined groove of substantially constant width in a predetermined pattern completely through said finish from the front face only of said panel and partially into said core, (d) an elongated strip of substantially constant width and thickness mounted over and along the bottom wall of said groove, the inboard edge of said strip being in butting contact with said core and in slightly recessed relation to the outer surface of said panel and the outboard edge of said strip being disposed in the outboard corner of said groove in deeply recessed relation to the outer surface of said panel.

10. A relief panel, according to claim 9, wherein said pattern is rectangular and a strip is mounted in each portion thereof, the ends of said strips being mitered and in contact relation.

* * * * *